US008400239B2

(12) United States Patent
Graf et al.

(10) Patent No.: US 8,400,239 B2
(45) Date of Patent: Mar. 19, 2013

(54) SWITCHING DEVICE AND METHOD FOR INSERTING OR REMOVING A TOLERANCE INSERT IN A MAGNET CHAMBER OF A SWITCHING DEVICE

(75) Inventors: Josef Graf, Hahnbach (DE); Christian Sturm, Mistelgau (DE); Alexander Zhukowski, Amberg (DE); Norbert Zimmermann, Sulzbach-Rosenberg (DE); Reinhard Zinner, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/561,651

(22) Filed: Jul. 30, 2012

(65) Prior Publication Data

US 2012/0286906 A1 Nov. 15, 2012

Related U.S. Application Data

(63) Continuation of application No. 12/681,902, filed as application No. PCT/EP2008/061567 on Sep. 2, 2008.

(30) Foreign Application Priority Data

Oct. 9, 2007 (EP) ..... 07019739

(51) Int. Cl.
*H01H 9/02* (2006.01)
*H01H 13/04* (2006.01)

(52) U.S. Cl. ..... 335/202; 335/78; 335/132

(58) Field of Classification Search ..... 335/132, 335/202
See application file for complete search history.

(56) References Cited

U.S. PATENT DOCUMENTS

| | | | | |
|---|---|---|---|---|
| 2,391,668 | A | 12/1945 | Austin | |
| 2,495,325 | A | 1/1950 | Hamilton | |
| 2,550,110 | A | 4/1951 | Ellis | |
| 2,683,785 | A | 7/1954 | Miller | |
| 2,920,160 | A | 1/1960 | Heath | |
| 3,099,729 | A | 7/1963 | Leo | |
| 3,129,304 | A | 4/1964 | Hyink et al. | |
| 3,171,918 | A | 3/1965 | Killion | |
| 3,277,409 | A | 10/1966 | Faffart | |
| 3,643,190 | A | 2/1972 | Puetz et al. | |
| 4,398,165 | A | 8/1983 | Iketani | |
| 4,724,410 | A | 2/1988 | Degenhart | |
| 5,623,239 | A | 4/1997 | Sitar | |
| 6,023,212 | A * | 2/2000 | Mader | 335/202 |

FOREIGN PATENT DOCUMENTS

| | | |
|---|---|---|
| DE | 2415489 | 10/1975 |
| DE | 19635277 | 2/1998 |

* cited by examiner

*Primary Examiner* — Mohamad Musleh
(74) *Attorney, Agent, or Firm* — Harness, Dickey & Pierce, P.L.C.

(57) ABSTRACT

The switching device includes an actuation magnet provided in a magnet chamber and fixed in the magnet chamber by at least one spring element, at least one displaceable switch contact, the at least one displaceable switch contact being displaceable by the actuation magnet and at least one stationary switch contact, the magnet chamber including an assembly opening for inserting or removing a tolerance insert.

15 Claims, 5 Drawing Sheets

BACKGROUND ART

BACKGROUND ART

SWITCHING DEVICE AND METHOD FOR INSERTING OR REMOVING A TOLERANCE INSERT IN A MAGNET CHAMBER OF A SWITCHING DEVICE

PRIORITY STATEMENT

This U.S. nonprovisional application is a continuation of U.S. application Ser. No. 12/681,902, filed Apr. 7, 2010 which is a national stage application under 35 U.S.C. §371 of PCT International Application No. PCT/EP2008/061567 which has an International filing date of Sep. 2, 2008, which designates the United States of America, and which claims priority on European patent application number EP07019739 filed Oct. 9, 2007, the entire contents of each of which are hereby incorporated herein by reference.

FIELD

At least one embodiment of the invention generally relates to a switching device. Particularly, at least one embodiment relates to a low-voltage switching device, having an actuation magnet provided in a magnet chamber and fixed in the magnet chamber by at least one spring element, having at least one displaceable switch contact and at least one stationary switch contact, the at least one displaceable switch contact being displaceable by the actuation magnet. At least one embodiment the invention further generally relates to a method for inserting or removing a tolerance insert in a magnet chamber of such a switching device of this type.

BACKGROUND

Switching devices, particularly low-voltage switching devices, enable switching of the current paths between an electric power supply device and consumers and thus of their operating currents, i.e. when current paths are opened and closed by the switching device, the connected consumers can be securely switched on and off.

An electric low-voltage switching device, such as for example a contactor, a circuit breaker, a motor branch circuit or a compact starter, has for switching one or more current circuit(s) one or more so-called main contact(s) or auxiliary contacts which can be controlled by one or even more actuation magnets, i.e. electromagnetic drives. In principle, the main or auxiliary contacts each consist of a displaceable contact, in particular a contact bridge, and a stationary contact or a stationary contact piece, to which the consumer and the supply device are connected. To close and open a main or auxiliary contact, a corresponding on- and off-switching signal is given to the actuation magnet, whereupon this magnet acts with its armature upon the displaceable contact such that the displaceable contact or the contact bridge completes a relative movement in relation to the stationary contact and either closes or opens the current path to be switched.

For improved contacting between a stationary contact and a displaceable contact, appropriately fashioned contact surfaces are provided at points at which the two meet. These contact surfaces consist of materials such as, for example, silver alloys which are applied at these points both on the displaceable contact, i.e. the contact bridge, and on the stationary contact, i.e. the contact piece, and are of a defined thickness.

These mechanical switching devices have, because of the required tolerance of the parts, a tolerance insert by which the resilience of the switching contacts can be adjusted. By way of adjustment, the paths and resiliences can be controlled to a relatively precise degree, as a result of which the magnetic paths in the device can be kept small. This makes it possible to minimize the power loss of the equipment.

Until now, the adjustment of switching devices has been effected by a tolerance insert of different thicknesses, which is inserted into the closed magnet chamber. FIGS. 1 and 2 show this based on the example of a contactor. After assembly of the switching device 1, the paths and resiliences are determined in this example. If these lie outside the desired limit values, the tolerance insert 2 has to be replaced by thicker or thinner tolerance inserts.

This arrangement has the disadvantage that after the switching device 1 has been assembled and gauged, the tolerance insert 2 has to be replaced again. To do this, the switching device 1 has to be dismantled again and reassembled once more, i.e. in order to assemble a different tolerance insert 2 below the spring element 6, which is arranged below the actuation magnet 4, the actuation magnet 4 and the spring element 6 have to be removed from the magnet chamber 3. This is associated with a high outlay in terms of design and time.

SUMMARY

At least one embodiment of the of the present invention is directed to a switching device, which enables easy and fast adjustment of the switching device after final assembly and gauging of the switching device. The insertion or the replacement of a tolerance insert in the magnet chamber of the switching device will be able to be effected in a particularly simple manner without the switching device or parts of the switching device, in particular the actuation magnet, having to be dismantled. Furthermore, a method will be established in at least one embodiment that makes it possible for the switching device to be adjusted fully automatically.

At least one embodiment of the invention is directed to a switching device, and at least one embodiment is directed to a method. Further features and details of embodiments of the invention will emerge from the subclaims, the description and the drawings. Features and details which are described in connection with the switching device also apply of course in connection with the two methods, and vice versa.

According to the first aspect of at least one embodiment of the invention, a switching device, particularly a low-voltage switching device, includes an actuation magnet provided in a magnet chamber and fixed in the magnet chamber by at least one spring element, having at least one displaceable switch contact and at least one stationary switch contact, the at least one displaceable switch contact being displaceable by the actuation magnet, the magnet chamber having an assembly opening for inserting or removing a tolerance insert.

A switching device of this type makes it possible for adjustment of the switching device to be carried out after final assembly and gauging of the switching device. This is made possible in particular by the fact that the magnet chamber has an assembly opening for inserting or removing a tolerance insert. In order to insert the tolerance insert into the magnet chamber or to remove it from this chamber, an actuation element is introduced into the assembly opening. The actuation element grips the actuation magnet inside the magnet chamber and presses or pulls this magnet in the direction of the spring element arranged below the actuation magnet.

Due to the force exerted on the spring element, the spring element is compressed. A free space, a gap, is produced as a result in the upper region of the magnet chamber. A tolerance insert, which is used to adjust the switching device, can be inserted into the free space. The tolerance insert is inserted into the free space through the assembly opening.

After the tolerance insert has been inserted, the actuation element which has held the actuation magnet is removed from the magnet chamber so the actuation magnet is pressed due to the spring force of the spring element in the direction away from the spring element. The upper region of the actuation magnet abuts against the inserted tolerance insert. After the tolerance insert has been inserted, the paths and resiliences of the contacts can be determined.

If it is established that these lie outside the desired limit values, the tolerance insert can simply be replaced by a correspondingly thinner or thicker tolerance insert. To do this, the actuation magnet has only to be displaced in the direction of the spring element by way of the actuation element which can be introduced through the assembly opening. The tolerance insert can then be removed from the magnet chamber and the new tolerance insert inserted.

An advantage of a switching device of this type is the possibility of precisely adjusting the paths and resiliences of the switching device in a production process. The magnetic path of the electromagnetic drive, i.e. of the actuation magnet, can in this way be kept to a minimum dimension. This in turn has the advantage of reducing the power loss of the electromagnetic drives and, in association therewith, of lowering the electricity requirement for the end consumer. Furthermore, with a switching device of this type, all the switching devices in a production process can be adjusted fully automatically. The intervention by means of the actuation element can be effected automatically.

A further example embodiment is a switching device in which the assembly opening is provided on a side or side wall of the magnet chamber. An assembly opening in a side wall makes it possible for the tolerance insert to be inserted into the free space produced above the actuation magnet. The assembly opening is arranged in particular at the upper end of a side wall of the magnet chamber. The "upper end" in this case is the end of a side wall which faces way from the spring element located in the magnet chamber. The assembly opening can extend as far as the side edge of the side, i.e. the side wall, of the magnet chamber. The assembly opening has at least the width and height of the largest possible tolerance insert. However, the assembly opening is preferably fashioned somewhat larger than the tolerance insert. In this way, the actuation element can also be introduced through the assembly opening without this element hampering the insertion or removal of the tolerance insert.

A switching device in which the assembly opening is provided in the region of the drive of the actuation magnet in the magnet chamber is particularly preferable. This can prevent the coil of the actuation magnet from being damaged as the tolerance insert is inserted or removed. The same applies to the introduction of the actuation element for pressing or pulling down the actuation magnet. This does not damage the coil of the actuation magnet during insertion if the assembly opening is provided in the region of the drive of the actuation magnet.

The actuation element is a tool which is suitable for pressing or pulling the actuation magnet in the direction of the spring element arranged below the actuation magnet. In a simple embodiment, the actuating element can, for example, be a screwdriver, with the aid of which the actuation magnet can be pressed in the direction of the spring element. The actuation element can also be a robotic arm, a gripping arm or a wire frame which can be operated automatically.

The assembly opening can be fashioned in various forms. It is crucial that an appropriate tolerance insert can be inserted though the assembly opening. An example embodiment is a switching device in which the assembly opening has a slot-shaped opening. In this way, the tolerance insert, which usually has the shape of a check card, can be inserted easily though the assembly opening into the free space in the magnet chamber.

In a further example embodiment of the switching device, it can be provided that the assembly opening extends from a side of the magnet chamber to a lid element of the magnet chamber. The lid element is in this case the lid element which faces toward the side of the actuation magnet facing away from the spring element. In this way, the tolerance insert can be inserted into the magnet chamber very securely, but also easily removed from the chamber. An inserted tolerance insert can be gripped more easily if the assembly opening extends from the side to the lid element of the magnet chamber.

A further example embodiment is a switching device in which the actuation magnet has a coil body comprising at least one recess or one projection for receiving an actuation element. The actuation element preferably grips the coil body of the actuation magnet in order not to damage the coil of the actuation magnet. To grip or engage behind the coil body, the coil body therefore preferably has recesses or projections. The recesses, also designated notches, can be fashioned such that, for example, a gripping element can penetrate them. The coil body can, however, also have projections, on which a lever tool or a gripping tool can engage.

The actuation element is advantageously a gripping element comprising one or more gripping arm(s). The latter penetrates into the recesses or engages on the projections in order to displace the actuation magnet in the direction of the spring element. The recesses can have angular or else round shapes, depending on the embodiment of the actuation element.

A further example embodiment is a switching device in which the magnet chamber has on the inner wall facing the actuation magnet at least one recess or one projection for receiving an actuation element. These can serve as seats for the actuation element in order to press the actuation magnet "downward", i.e. these recesses or these projections serve as a fastening for an actuation element embodied as a lever.

A particular example embodiment is a switching device in which the magnet chamber, particularly a lid element of the magnet chamber, has at least one actuation opening for introducing an actuation element into the magnet chamber. This means that the actuation element does not have to be introduced into the magnet chamber through the assembly opening. As a result, the assembly opening can be optimally dimensioned to suit the dimensions of the tolerance insert. The actuation element does not then hamper the tolerance insert when the latter is inserted or removed.

The actuation opening can be provided on a side of the magnet chamber, but, also on the lid element of the magnet chamber which faces toward the side of the actuation magnet facing away from the spring element. By way of the actuation element, the actuation magnet can easily be displaced in the direction of the spring element inside the magnet chamber and held in a displaced position such that the tolerance insert can be inserted through the assembly opening into the free space produced above the actuation magnet. Several actuation openings are preferably provided in the magnet chamber, particularly in the lid element of the magnet chamber. This enables secure and even displacement of the actuation magnet inside the magnet chamber.

In another embodiment of the switching device, the actuation openings can also be provided on the lid element, also designated the floor element, facing toward the spring element. In this way, the actuation magnet can, after intervention of the actuation element, be pulled in the direction of the spring element in order to create the free space inside the magnet chamber for inserting the tolerance insert.

The actuation opening(s) can be fashioned in various forms. They serve the introduction of one or more actuation elements which serve in displacing the actuation magnet, i.e. the electromagnetic drive.

An example embodiment is a switching device in which the at least one actuation opening extends from a side of the magnet chamber to a lid element of the magnet chamber. This ensures that there is adequate space for the intervention of the actuation element.

In order that no dirt particles can penetrate the magnet chamber, a switching device is preferred in which the assembly opening can be closed by a closing element. The closing element can, for example, be an attachable lid or a flap hinged on the magnet chamber. To insert or remove the tolerance insert, the closing element can be opened or removed.

A switching device is also conceivable in which the at least one actuation opening can be closed by a closing element. This can likewise prevent dirt or contamination from penetrating the magnet chamber when no insertion or removal of the tolerance insert is taking place. This/these closing element (s) can also be fashioned as an attachable lid or as a hinged flap.

The assembly insert is preferably a plate which can be inserted through the assembly opening. The thickness of the assembly insert can differ depending on the adjustment necessary.

The switching device can be a contactor or a circuit breaker or a compact branch circuit or a compact starter. A low-voltage switching device is particularly preferred.

According to the second aspect of an example embodiment of the invention, a method is disclosed for inserting or removing a tolerance insert in the magnet chamber of a switching device according to the first aspect, an actuation element being guided though the assembly opening and gripping or engaging behind the coil body of the actuation magnet, the coil body, after being gripped or engaged behind, being pulled or pressed by the actuation element in the direction of the spring element and, after displacement of the coil body of the actuation magnet in the direction of the spring element, a tolerance insert being inserted through the assembly opening into the free space produced above the coil body of the actuation magnet or being removed from the free space produced above the coil body of the actuation magnet.

Such a method for inserting or removing a tolerance insert in a magnet chamber of a switching device enables easy and fast adjustment of the switching device after final assembly and gauging of the switching device. This is made possible by the fact that the tolerance insert is inserted in the magnet chamber or removed from the magnet chamber through an assembly opening in the magnet chamber.

The actuation element grips the actuation magnet inside the magnet chamber and presses or pulls this magnet in the direction of the spring element arranged below the actuation magnet. The spring element is compressed due to the force exerted on the spring element. A free space is produced in the upper region of the magnet chamber as a result. The tolerance insert which serves in adjusting the switching device is inserted into the free space.

After the tolerance insert has been inserted, the actuation element which has held the actuation magnet is removed from the magnet chamber so due to the spring force of the spring element the actuation magnet is pressed in the direction away from the spring element. In the process, the upper region of the actuation magnet abuts against the inserted tolerance insert. After the tolerance insert has been inserted, the paths and resiliences of the contacts can be determined.

If it is determined that these lie outside the desired limit values, the tolerance insert can simply be replaced by a correspondingly thinner or thicker tolerance insert. To do this, the actuation magnet is displaced in the direction of the spring element by way of the actuation element which can be introduced through the assembly opening. The tolerance insert is then removed from the magnet chamber and the new tolerance insert inserted.

An advantage of such a method is the possibility of precisely adjusting the paths and resiliences of the switching device in a production process. The magnet path of the electromagnetic drive, i.e. of the actuation magnet, can be dimensioned to a minimum. This in turn has the advantage of reducing the power loss of the electromagnetic drives and, in association therewith, of lowering the electricity requirement for the end consumer. Furthermore, all the switching devices in a production process can be adjusted using such a method.

As an alternative to the method described previously, a method for inserting or removing a tolerance insert in a magnet chamber of a switching device is disclosed, for example, in which an actuation element is guided through the at least one actuation opening and grips or engages behind the coil body, in which after the coil body has been gripped or engaged behind, this coil body is pressed by the actuation element in the direction of the spring element and in which after the displacement of the coil body of the actuation magnet in the direction of the spring element a tolerance insert is inserted through the assembly opening into the free space produced above the coil body of the actuation magnet or is removed from the free space produced above the coil body of the actuation magnet.

As distinct from the first described method, the actuation element is introduced into the magnet chamber in order to grip or engage behind the actuation magnet, i.e. the coil body of the actuation magnet, and in order to displace this magnet in the direction of the spring element arranged below the actuation magnet not through the assembly opening, but through the actuation opening. The insertion of the actuation element through the actuation opening makes it possible on the one hand for the tolerance insert to be inserted more easily through the assembly opening. Secondly, the actuation element can grip the coil body of the actuation magnet in an improved manner. The actuation opening or actuation openings are therefore preferably provided on the lid element of the magnet chamber.

A further example method is one in which the actuation element grips or engages behind at least one recess or one projection of the coil body of the actuation magnet. In this way, the actuation element engages securely on the coil body of the actuation magnet such that this coil body can be displaced securely in the direction of the spring element. A sliding of the actuation element off the coil body of the actuation magnet would cause the coil body and thus the actuation magnet to shoot out, which could result in damage to the tolerance insert. It is therefore preferable for the actuation element to engage in or on recesses or projections of the coil body of the actuation magnet. In this way, the actuation magnet can securely grip the actuation magnet and displace it appropriately in the magnet chamber.

A further example method is one in which after the tolerance insert has been inserted into the magnet chamber the actuation element is removed from the magnet chamber through the assembly opening or through the actuation opening. The actuation magnet can on the one hand be pulled by the actuation element in the direction of the inserted tolerance insert. On the other hand, the compressed spring element presses the actuation magnet in the direction of the tolerance insert. After the actuation magnet abuts against the tolerance insert, the actuation element is removed from the magnet chamber. The closing elements on the assembly opening and on the at least one actuation opening are then closed so no contaminants can pass into the magnet chamber.

BRIEF DESCRIPTION OF THE DRAWINGS

The invention will now be explained in detail with the aid of example embodiments and with reference to the attached drawings, in which.

DETAILED DESCRIPTION OF THE EXAMPLE EMBODIMENTS

Figure 1:
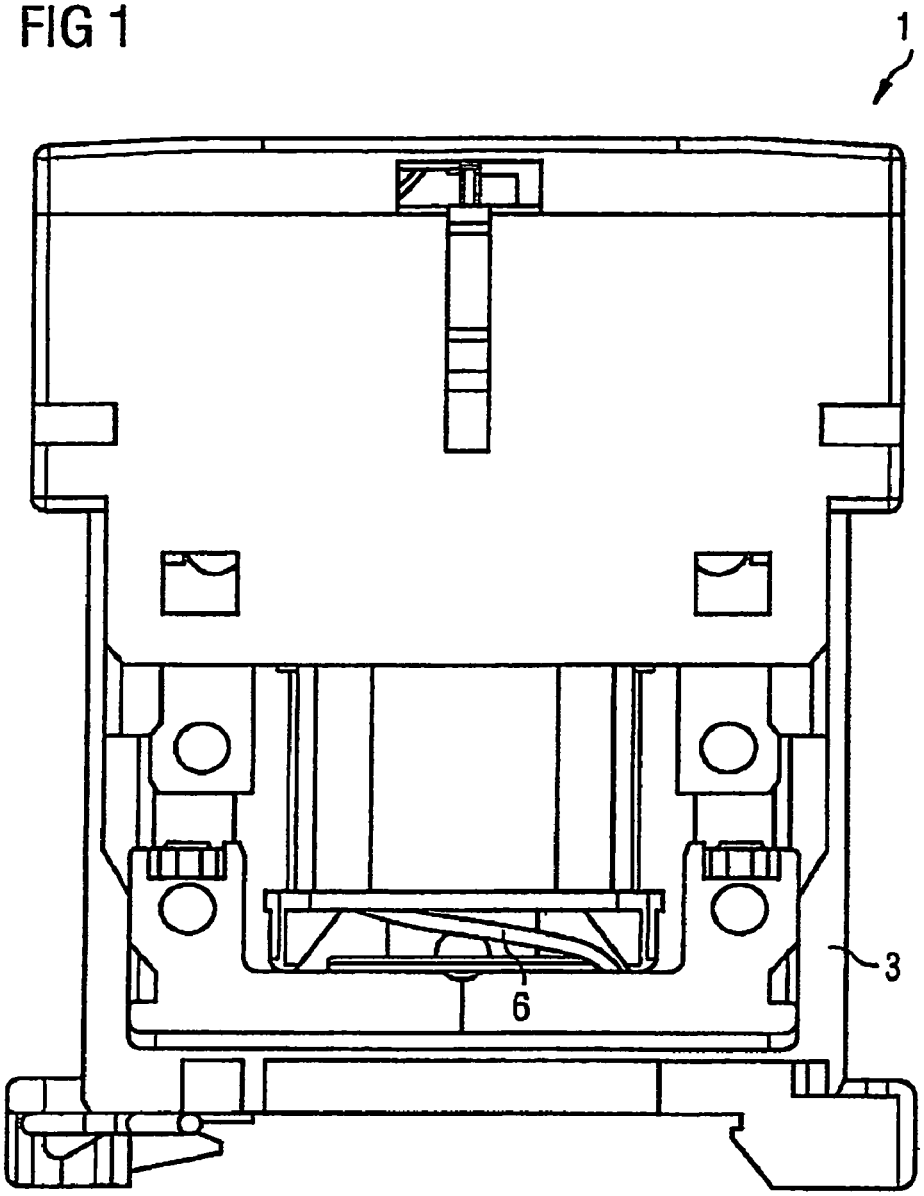
FIG. 1 shows a front view of a switching device having an inserted tolerance insert according to the prior art.
Figure 2:
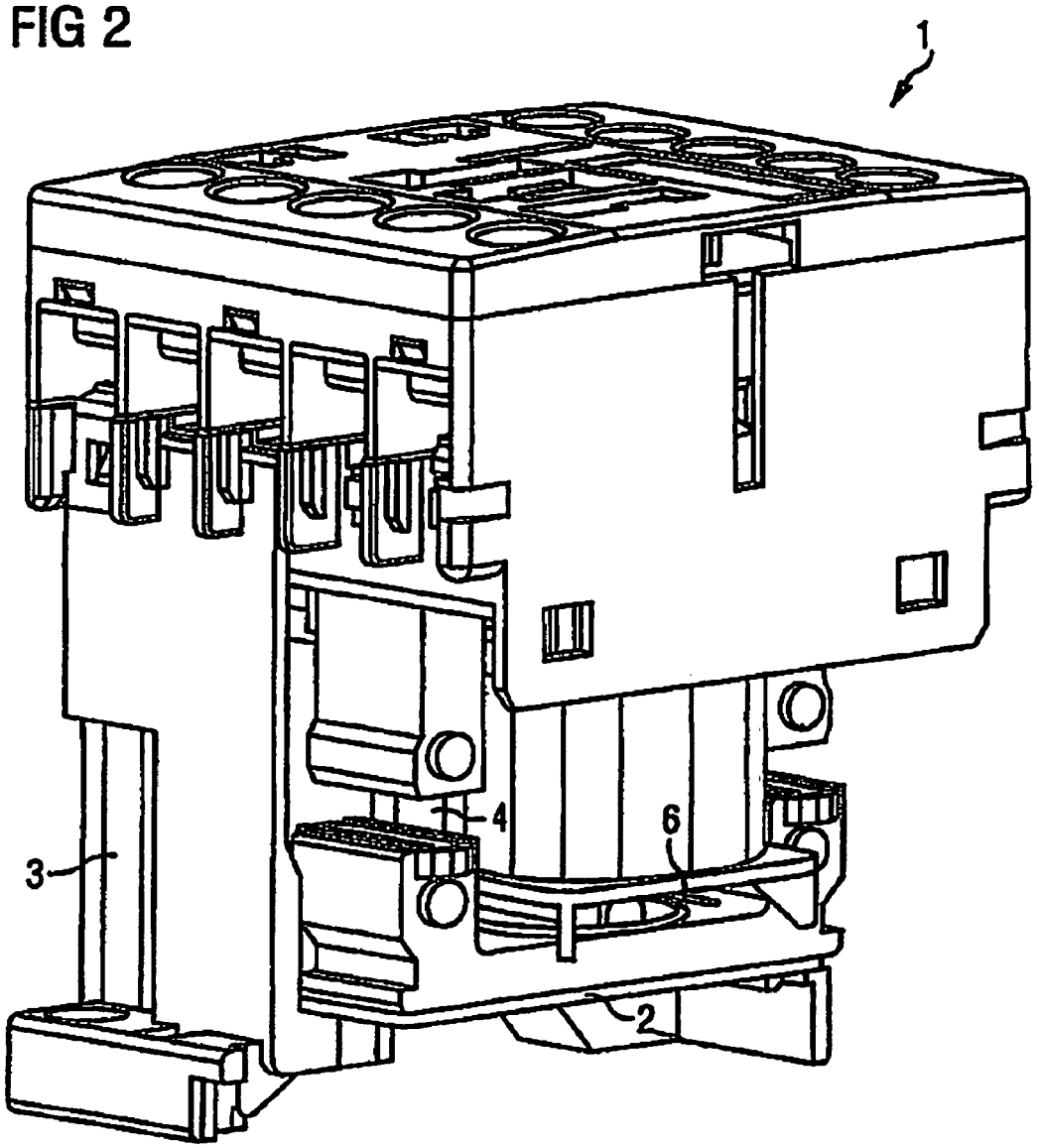
FIG. 2 shows a perspective view of the switching device according to FIG. 1.

FIGS. 1 and 2 show a switching device according to the prior art, as described in the introduction to the description.

Figure 3:
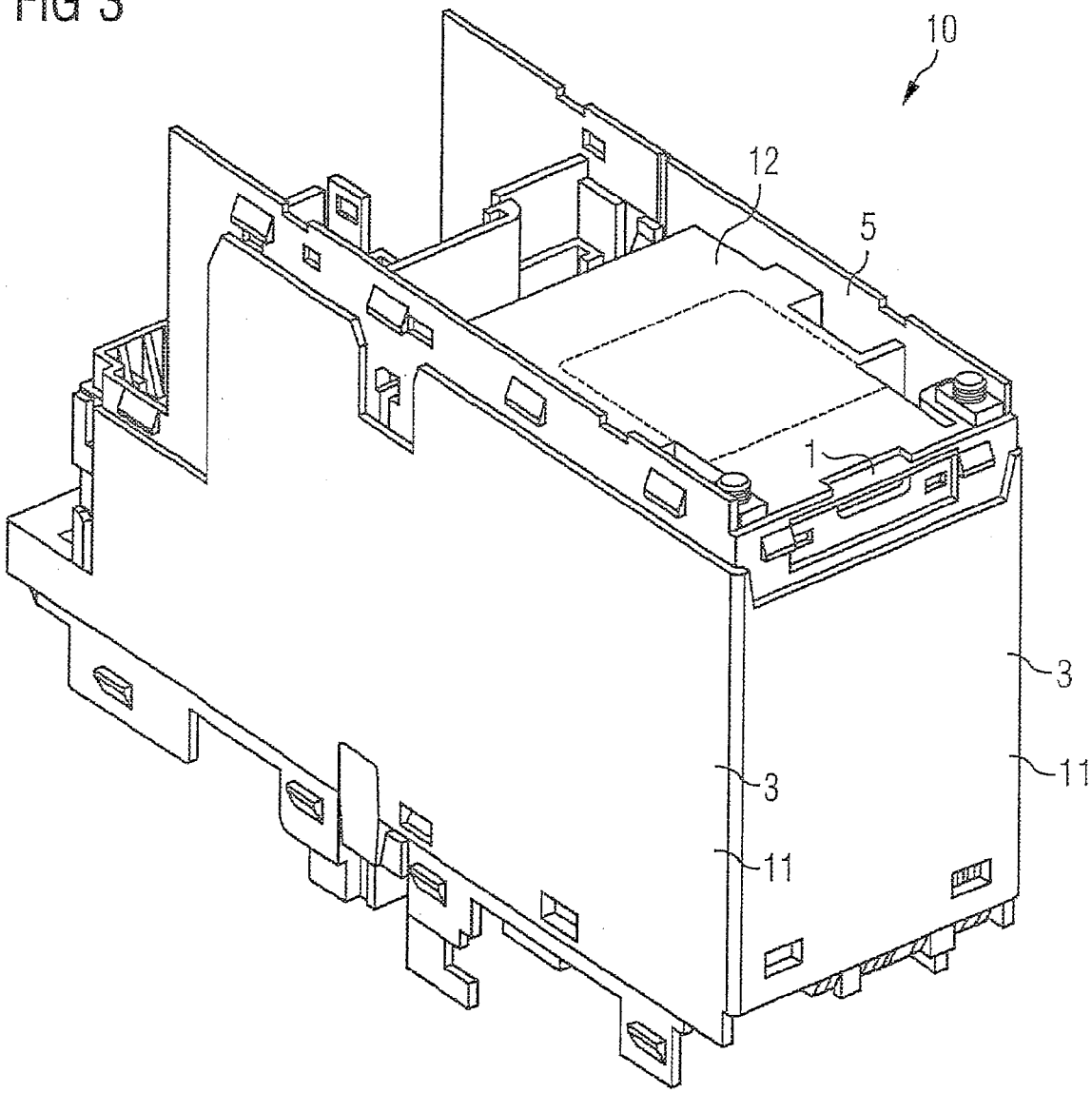
FIG. 3 shows a perspective view of a switching device having an assembly opening and an actuation opening.
Figure 4:
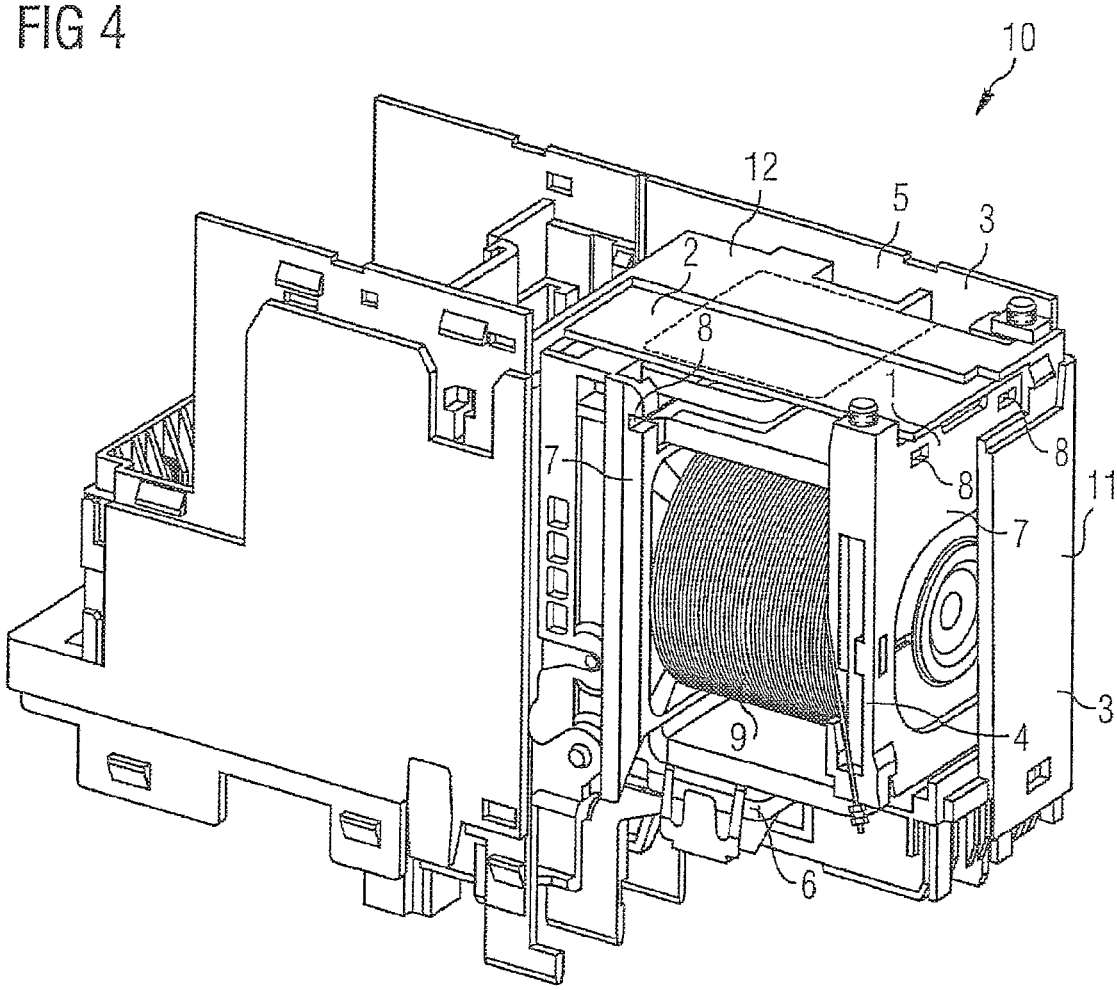
FIG. 4 shows a different perspective view of a switching device having an assembly opening and an actuation opening.
Figure 5:
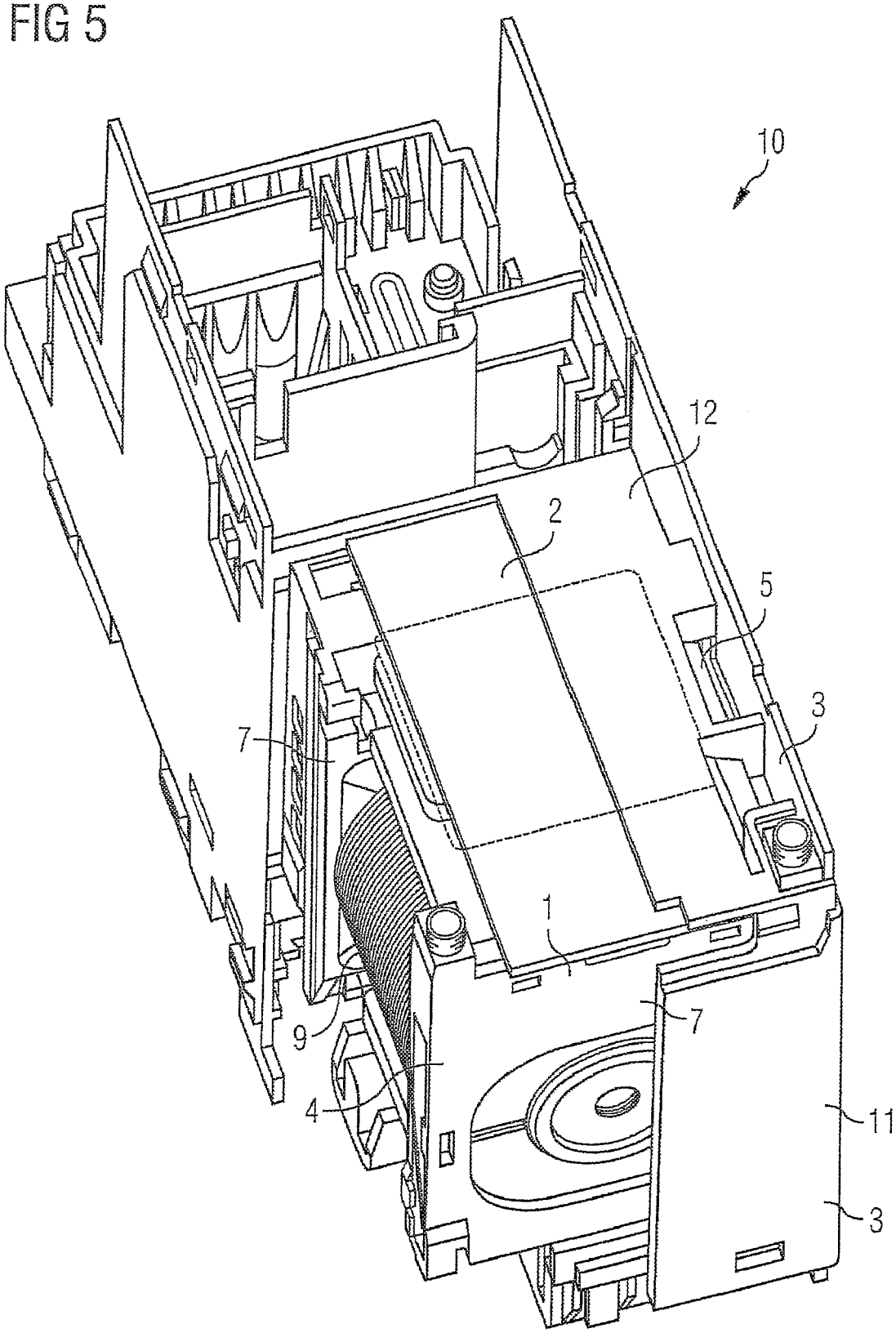
FIG. 5 shows a further perspective view of a switching device having an assembly opening and an actuation opening.

FIGS. 3 to 5 each represent a perspective view of a switching device 10 having an assembly opening 1 and an actuation opening 5. FIG. 3 shows the magnet chamber 3 of the switching device 10. The assembly opening 1 is arranged at the upper end of the side 11 of the magnet chamber 3, i.e. of the side wall of the magnet chamber 3. This assembly opening extends from the side wall 11 to the lid element 12 of the magnet chamber 3. This enables in particular easy removal of the tolerance insert 2 from the magnet chamber 3.

The tolerance insert 2 can in the case of an assembly opening 1 of this type easily be gripped and pulled out of the magnet chamber 3 through the assembly opening 1. The tolerance insert 2 is inserted from outside into the magnet chamber 3, i.e. into the free space above the actuation magnet 4, without the switching device 10 having to be dismantled. The actuation magnet 4, i.e. the electromagnetic drive, is fixed in the magnet chamber 3 by a spring element 6.

To assemble the tolerance insert 2, the actuation magnet 4 has therefore firstly to be displaced downward. "Downward" here means that the actuation magnet 4 is displaced in the direction of the spring element 6. The spring element 6 is compressed as a result. In order to displace the actuation magnet 4 downward, an actuation element is introduced into the magnet chamber 3 through the actuation opening 5. The actuation element grips the actuation magnet 4 and pushes this magnet downward. The tolerance insert 2 can then be assembled in the free space produced in this way. After assembly, the actuation magnet 4 is pulled upward again by the actuation element and the assembly of the switching device 10 can be continued.

A switching device 10 of this type enables precise adjustment of the paths and resiliences of the switching device 10 in a production process, by means of which the magnet path of the actuation magnet 4 can be dimensioned to a minimum. Furthermore, the power loss of the actuation magnet 4 can be reduced by a switching device 10 of this type and, in association therewith, a lower power requirement generated for the end consumer. Furthermore, switching devices 10 of this type can be adjusted fully automatically in a production process.

FIGS. 4 and 5 each show a perspective view of a switching device 10 having an assembly opening 1 and an actuation opening 5, part of the side walls of the magnet chamber 3 not being represented so that the actuating magnet 4 is shown. The tolerance insert 2 has been inserted into the free space between the actuation magnet 4 and the lid element 12 of the magnet chamber 3. The tolerance insert 2 has been inserted into the free space through the assembly opening 1.

The coil body 7 of the actuation magnet 4 has recesses 8 in which the actuation element can engage. This enables a secure engagement of the actuation element on the coil body 7 and thus on the actuation magnet 4 in order to push this magnet securely in the direction of the spring element. The coil body 7 encloses the coil of the actuation magnet 4. The spring element 6 is arranged in the magnet chamber 3 below the actuation magnet 4 and fixes the actuation magnet 4 as a result in the magnet chamber 3. The spring element 6 can be fashioned in a variety of forms. The spring element 6 can, for, example, be fashioned as a disk spring, as a leaf spring or as a coil spring.

The switching device can in particular be a multipolar low-voltage switching device of the contactor type, a circuit breaker or a motor branch circuit in a combination of contactor and circuit breaker or a compact starter, with one or two switching points for operational switching and for overload and short-circuit cut-off. In switching devices of this type, the displaceable contacts of the various poles are actuated by an actuation magnet and a mechanical system, e.g. a switch lock.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switching device, comprising:

an actuation magnet provided in a magnet chamber and fixed in the magnet chamber by at least one spring element;

at least one displaceable switch contact, the at least one displaceable switch contact being displaceable by the actuation magnet; and at least one stationary switch contact, the magnet chamber including an assembly opening in an exterior surface of the switching device for inserting or removing a tolerance insert, wherein the magnet chamber includes at least one actuation opening in an exterior surface of the switching device for introducing an actuation element into the magnet chamber.

2. The switching device as claimed in claim 1, wherein the assembly opening is provided on a side wall of the magnet chamber.

3. The switching device as claimed in claim 1, wherein the assembly opening is provided in a region of a drive of the actuation magnet in the magnet chamber.

4. The switching device as claimed in claim 1, wherein the assembly opening is a slot-shaped opening.

5. The switching device as claimed in claim 1, wherein the assembly opening extends from a side of the magnet chamber to a lid element of the magnet chamber.

6. The switching device as claimed in claim 1, wherein the actuation magnet comprises a coil body including at least one recess or one projection for receiving an actuation element.

7. The switching device as claimed in claim 1, wherein the magnet chamber includes, on an inner wall facing the actuation magnet, at least one recess or one projection for receiving an actuation element.

8. The switching device as claimed in claim 1, wherein the at least one actuation opening extends from a side of the magnet chamber to a lid element of the magnet chamber.

9. The switching device as claimed in claim 1, wherein the at least one actuation opening is closeable by a closing element.

10. The switching device as claimed in claim 1, wherein the assembly opening is closeable by a closing element.

11. The switching device as claimed in claim 1, wherein the tolerance insert is a plate which is insertable through the assembly opening.

12. The switching device as claimed in claim 1, wherein the switching device is a contactor or a circuit breaker or a compact branch circuit or a compact starter.

13. The switching device of claim 1, wherein the switching device is a low-voltage switching device.

14. The switching device as claimed in claim 2, wherein the assembly opening is provided in a region of a drive of the actuation magnet in the magnet chamber.

15. The switching device as claimed in claim 1, wherein a lid element of the magnet chamber includes at least one actuation opening for introducing an actuation element into the magnet chamber.

* * * * *